US009074391B2

(12) United States Patent
Van Parys

(10) Patent No.: US 9,074,391 B2
(45) Date of Patent: Jul. 7, 2015

(54) PANIC LOCK

(71) Applicant: Remi Emiel Van Parys, Waregem (BE)

(72) Inventor: Remi Emiel Van Parys, Waregem (BE)

( * ) Notice: Subject to any disclaimer, the term of this patent is extended or adjusted under 35 U.S.C. 154(b) by 152 days.

(21) Appl. No.: 13/887,700

(22) Filed: May 6, 2013

(65) Prior Publication Data

US 2013/0291606 A1 Nov. 7, 2013

(30) Foreign Application Priority Data

May 7, 2012 (BE) ..... 2012/0299

(51) Int. Cl.

| | |
|---|---|
| ***E05B 59/00*** | (2006.01) |
| ***E05B 65/06*** | (2006.01) |
| ***E05B 63/00*** | (2006.01) |
| ***E05B 63/16*** | (2006.01) |
| ***E05B 65/10*** | (2006.01) |
| *E05B 63/04* | (2006.01) |

(52) U.S. Cl.

CPC ..... *E05B 65/06* (2013.01); *E05B 59/00* (2013.01); *E05B 63/0065* (2013.01); *E05B 63/04* (2013.01); *E05B 63/16* (2013.01); *E05B 65/1086* (2013.01)

(58) Field of Classification Search

CPC ..... E05B 59/00; E05B 65/1086; E05B 63/16; E05B 63/04

USPC ..... 70/92, 465, 107, 110, 111, 124, 129, 70/134; 292/92, DIG. 65, 137, 138, 140, 292/143, 95, 96, 98–100, 197–200

See application file for complete search history.

(56) References Cited

U.S. PATENT DOCUMENTS

| | | | | | |
|---|---|---|---|---|---|
| 1,368,727 | A | * | 2/1921 | Hurd | 70/153 |
| 3,633,389 | A | * | 1/1972 | Horgan, Jr. | 70/120 |
| 3,672,714 | A | * | 6/1972 | Schultz | 292/34 |
| 3,769,822 | A | * | 11/1973 | Yulkowski | 70/107 |
| 3,819,213 | A | * | 6/1974 | Vanderburgh | 292/21 |
| 3,881,331 | A | * | 5/1975 | Tranberg et al. | 70/107 |
| 4,481,796 | A | * | 11/1984 | Hamme | 70/107 |
| 4,583,382 | A | * | 4/1986 | Hull | 70/107 |
| 4,695,082 | A | * | 9/1987 | Marks | 292/169.16 |
| 4,838,053 | A | * | 6/1989 | Shen | 70/92 |
| 4,978,151 | A | * | 12/1990 | Coleman et al. | 292/21 |
| 4,986,576 | A | * | 1/1991 | Anderson | 292/40 |
| 5,655,393 | A | * | 8/1997 | Kuo et al. | 70/107 |
| 5,813,255 | A | * | 9/1998 | Tell et al. | 70/107 |
| 5,890,753 | A | * | 4/1999 | Fuller | 292/337 |
| 6,000,733 | A | * | 12/1999 | Linder | 292/92 |
| 6,282,929 | B1 | * | 9/2001 | Eller et al. | 70/109 |
| 6,393,878 | B1 | * | 5/2002 | Fayngersh et al. | 70/107 |
| 6,581,426 | B2 | * | 6/2003 | Bates et al. | 70/278.7 |
| 6,651,466 | B1 | * | 11/2003 | Shih | 70/107 |
| 6,688,656 | B1 | * | 2/2004 | Becken | 292/26 |

(Continued)

FOREIGN PATENT DOCUMENTS

| | | |
|---|---|---|
| EP | 0 795 665 A2 | 9/1997 |
| EP | 1 743 994 A2 | 1/2007 |

(Continued)

*Primary Examiner* — Christopher Boswell
*Assistant Examiner* — Morgan McClure
(74) *Attorney, Agent, or Firm* — Sughrue Mion, PLLC

(57) ABSTRACT

A Panic lock for building into a door (2) or similar, with the panic lock including a lock case (3); a dead bolt (6); a latch bolt (8); an operating bar (12), wherein the panic lock includes a device that enable the same lock to be converted to realize the panic functions 'B, D or E' by moving or removing one or two screws, depending on the desired application.

20 Claims, 14 Drawing Sheets

(56) References Cited

U.S. PATENT DOCUMENTS

| | | | | |
|---|---|---|---|---|
| 6,813,915 | B2 * | 11/2004 | Chang | 70/107 |
| 6,851,287 | B1 * | 2/2005 | Yang et al. | 70/107 |
| 6,899,361 | B2 * | 5/2005 | Dorn | 292/332 |
| 7,497,486 | B1 * | 3/2009 | Davis et al. | 292/32 |
| 7,926,315 | B2 * | 4/2011 | Poletti | 70/107 |
| 8,161,780 | B1 * | 4/2012 | Huml | 70/107 |
| 8,690,203 | B1 * | 4/2014 | Hickman et al. | 292/244 |
| 2001/0047671 | A1 * | 12/2001 | Grundler et al. | 70/107 |
| 2003/0061847 | A1 * | 4/2003 | Morris | 70/107 |
| 2003/0079508 | A1 * | 5/2003 | Lin | 70/107 |
| 2004/0107746 | A1 * | 6/2004 | Chang | 70/107 |
| 2004/0107747 | A1 * | 6/2004 | Chang | 70/107 |
| 2004/0261475 | A1 * | 12/2004 | Artsiely | 70/107 |
| 2005/0046198 | A1 * | 3/2005 | Alexander et al. | 292/163 |
| 2005/0212301 | A1 * | 9/2005 | Huang | 292/169.14 |
| 2008/0066505 | A1 * | 3/2008 | Poletti | 70/107 |
| 2008/0141740 | A1 * | 6/2008 | Shvartz | 70/107 |
| 2008/0156049 | A1 * | 7/2008 | Topfer | 70/107 |
| 2008/0265587 | A1 * | 10/2008 | Nakanishi et al. | 292/26 |
| 2009/0282877 | A1 * | 11/2009 | Laverty et al. | 70/107 |
| 2010/0236302 | A1 * | 9/2010 | Uyeda | 70/110 |
| 2010/0263418 | A1 * | 10/2010 | Moon | 70/107 |
| 2012/0013135 | A1 * | 1/2012 | Moon | 292/165 |
| 2012/0137742 | A1 * | 6/2012 | Isley | 70/124 |
| 2013/0277988 | A1 * | 10/2013 | Ji et al. | 292/33 |
| 2013/0291606 | A1 * | 11/2013 | Van Parys | 70/111 |
| 2014/0125068 | A1 * | 5/2014 | Hagemeyer et al. | 292/138 |
| 2014/0191514 | A1 * | 7/2014 | Nakanishi et al. | 292/36 |

FOREIGN PATENT DOCUMENTS

| | | | | |
|---|---|---|---|---|
| EP | 2 327 850 | A2 | 6/2011 | |
| GB | 2 466 518 | A | 6/2010 | |
| GB | 2466518 | A * | 6/2010 | E05C 9/04 |
| WO | 2011/072334 | A1 | 6/2011 | |

* cited by examiner

PANIC LOCK

FIELD OF THE INVENTION

The present invention relates to a panic lock, more specifically a panic lock for building into a door or similar.

BACKGROUND OF THE INVENTION

A lock in general and a panic lock in particular are, as known, provided with a latch bolt and a dead bolt that can be operated with a key or by means of a handle on the inside and/or outside of the door.

A panic lock is used for an emergency exit for example, whereby in the event of an emergency or panic it must always be specifically possible to open the door from the inside by means of a handle, even without a key, while from the outside it is not possible to enter inside by means of a handle on the outside, unless the person has the key or after a specific operation or combination of operations with the handle and/or with the key on the inside.

As with a panic lock the handle on the inside and a handle on the outside must not enable the same operations, it is typical for such panic locks to be equipped with two handle followers or handles that can turn with respect one another, and of which one handle follower or handle is intended to be able to be operated from the inside of the door and the other handle follower or handle is intended to be operated from the outside of the door.

Depending on the situation, the outside handle follower can be coupled to the inside handle follower to gain access with the outside handle, for example for emergency services.

Depending on what action or actions are required or desired to couple the outside handle follower to the inside handle follower after performing a panic action or panic movement to open the door with the handle on the inside, different types of panic locks are known, each with a different function.

A distinction is made between the 'B, D and E functions,' wherein:

- function E, whereby the handle followers are permanently coupled together, whereby a key is always required to be able to enter inside from the outside as there is no handle on the outside of the door;
- function D, whereby after performing a panic action with the inside handle, the handle followers are coupled together to thus gain access to the inside, also by means of the handle on the outside of the door, without a key or by means of the key if no handle is provided on the outside;
- function B, whereby, after performing a panic action with the inside handle, the handle followers are only coupled together after the latch bolt has first been pulled backwards once by means of the key, after which the door can be permanently opened along the outside with the handle until the dead bolt is again turned to the locked position.

A disadvantage of the known panic locks is that a different lock is required for each type.

A disadvantage attached to that is that these types must also be held in stock.

Moreover it is not possible to change the type without acquiring a new panic lock.

Additionally a panic lock can be mounted on the left or right of a door, whereby in the one case one of the handle followers or handles is the inside handle follower or handle while in the other case the other handle follower or handle is the inside handle follower or handle.

Also in this case two types of panic lock are generally needed each time.

A panic lock is indeed known from EP 1.743.994 in which, by moving a screw, it is possible to convert a panic lock from a left lock into a right lock and vice versa.

SUMMARY OF THE INVENTION

The purpose of the present invention is to provide a solution to the aforementioned and other disadvantages.

To this end the invention concerns a panic lock according to claim 1.

An advantage of a panic lock according to the invention is that it is possible, in a very simple way, by just moving or removing a catch, for example in the form of a screw, to convert a panic lock from a panic lock with function B into a panic lock with function D, and this while preserving the conventional functions of a normal lock for unlocking and locking the dead bolt and the latch bolt.

As a result it is not necessary to have a stock of each type of panic lock.

Preferably a interlock is provided that enables the coupling rod to be locked in the coupling position of the coupling rod with respect to the lock case or to be unlocked, depending on whether the desired function E of the panic lock must be realised.

Thus it is possible to realise three functions B, D and E with the same panic lock.

The locking of the interlock can be done by means of a screw, preferably the same screw that can be used as a catch to realise the functions B and D.

In such a case the position of this screw in one of three possible positions determines the desired function B, D or E.

Preferably the panic lock comprises means, for example in the form of a screw, that enable the panic plate to be connected in a tightened manner to the one or the other handle follower or handle, more specifically to the handle follower or handle that is intended to be used as the inside handle follower or handle.

In this way the functions B, D and E can also be combined in a simple way with the use of the panic lock as a left or right panic lock, and this on the basis of only one single lock by moving only two screws.

BRIEF DESCRIPTION OF THE DRAWINGS

With the intention of better showing the characteristics of the invention, a preferred embodiment of a panic lock according to the invention is described hereinafter by way of an example, without any limiting nature, with reference to the accompanying drawings, wherein.

DETAILED DESCRIPTION OF A PREFERRED EMBODIMENT

Figure 1:
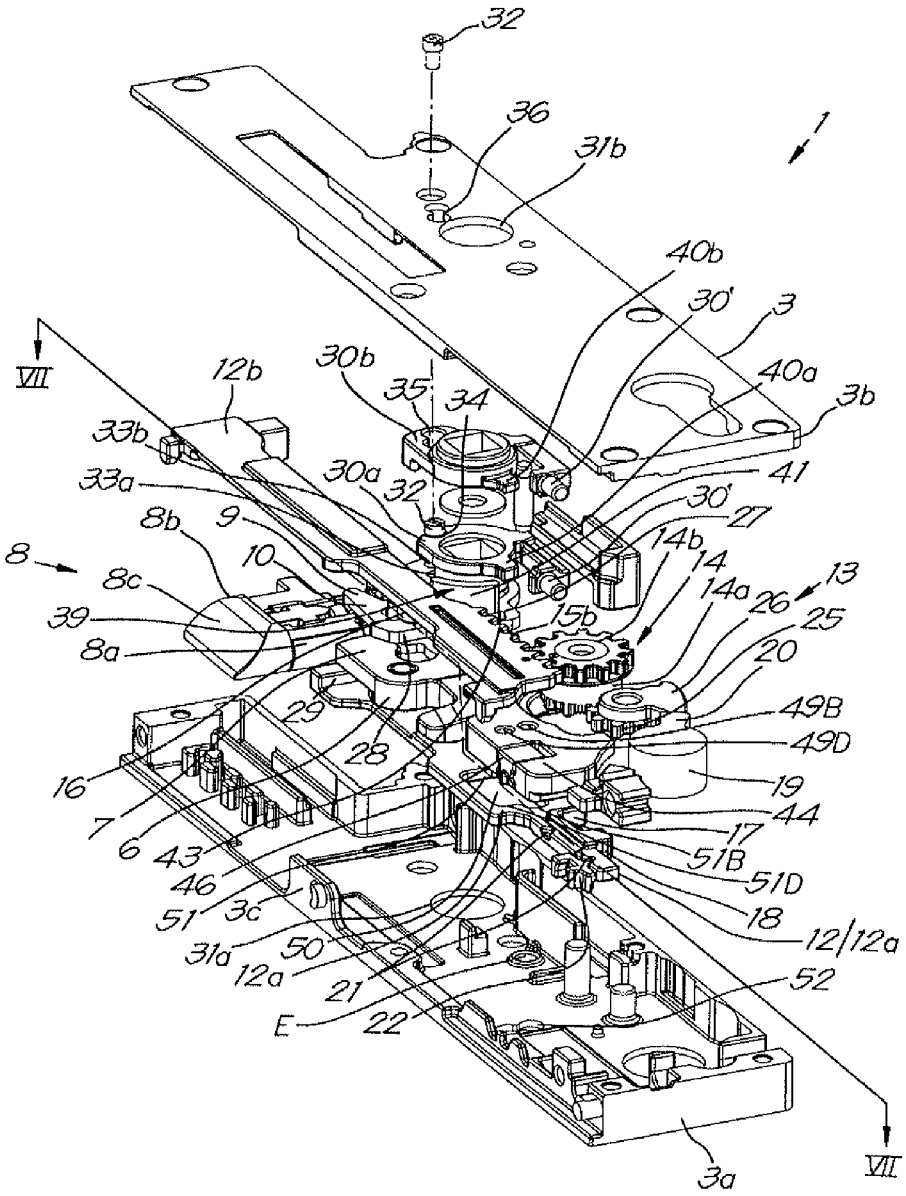
FIG. 1 shows an exploded perspective view of a panic lock according to the invention.

The panic lock 1 shown in the drawings for fitting into a door 2 or similar comprises a lock case 3 with a base 3*a* and a cover 3*b* and a side 3*c*, which upon mounting in the lock opening of a door 2 is visible at the side edge of the door 2 and which is then covered by a 'face plate'.

Figure 3:
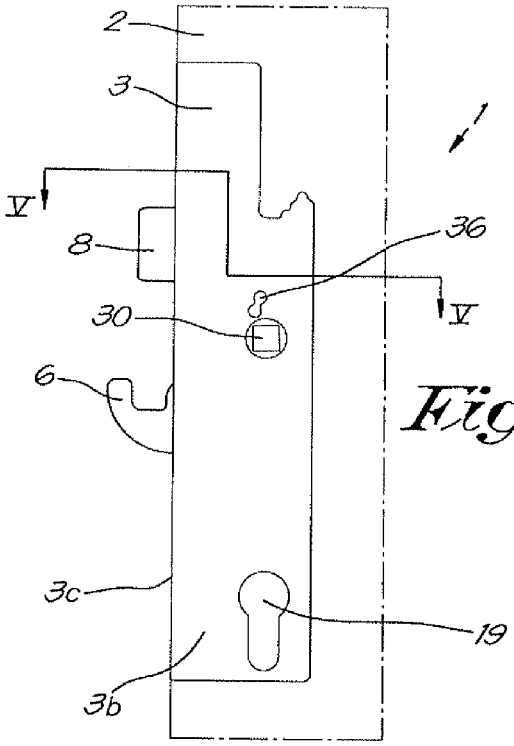
FIG. 3 shows a panic lock as fitted in a door 2 as a left lock.
Figure 4:
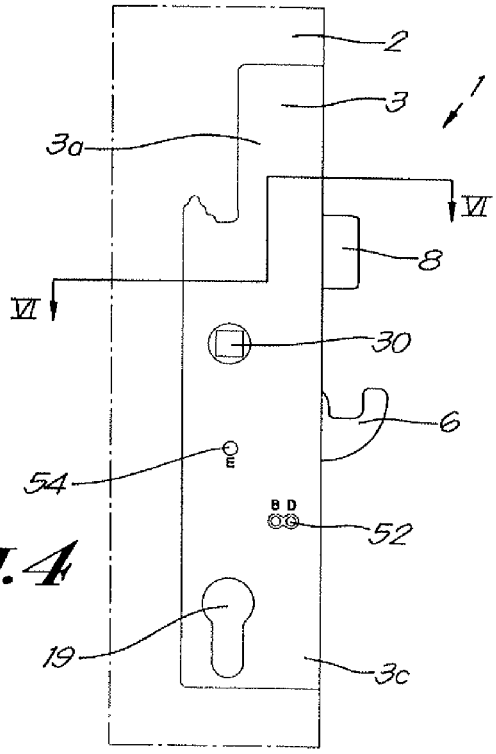
FIG. 4 shows a view as fitted in a door 2 as a right lock.
Figure 5:
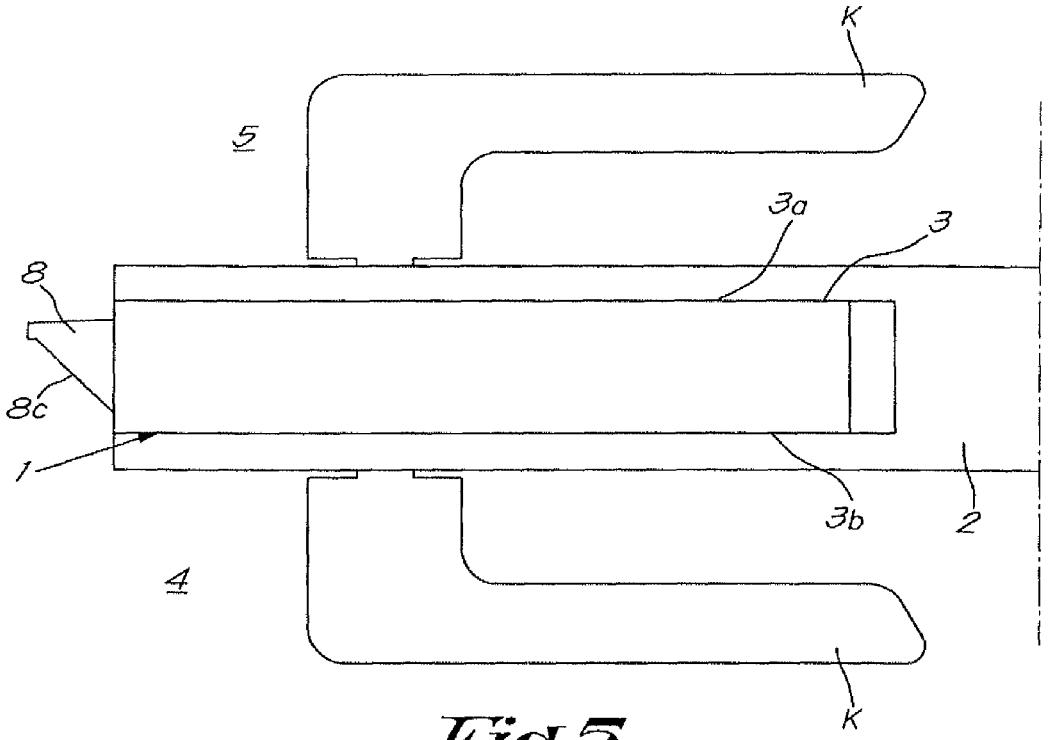
FIGS. 5 and 6 show a cross-section, according to lines V-V and VI-VI in FIGS. 3 and 4 respectively.
Figure 6:
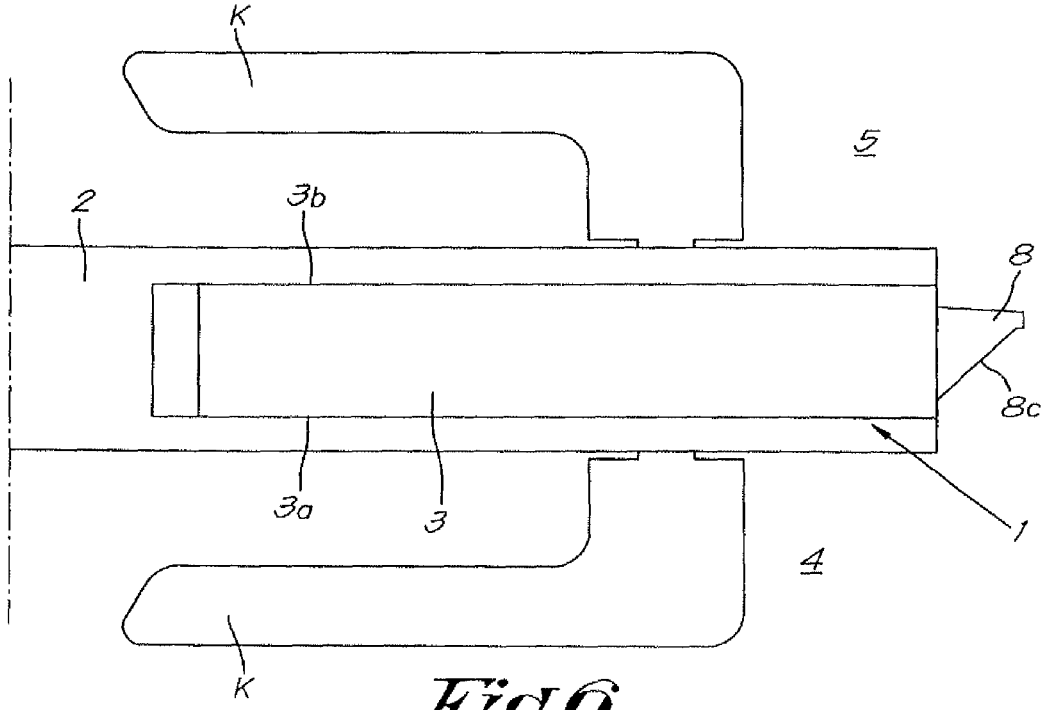

Depending on the situation, the panic lock 1 can either be fitted as a left lock in the door 2 with the cover 3*b* oriented to the inside 4, as shown in FIGS. 3 and 5, or as a right lock with the cover 3*b* oriented to the outside 5, such as in FIGS. 4 and 6.

Figure 2:
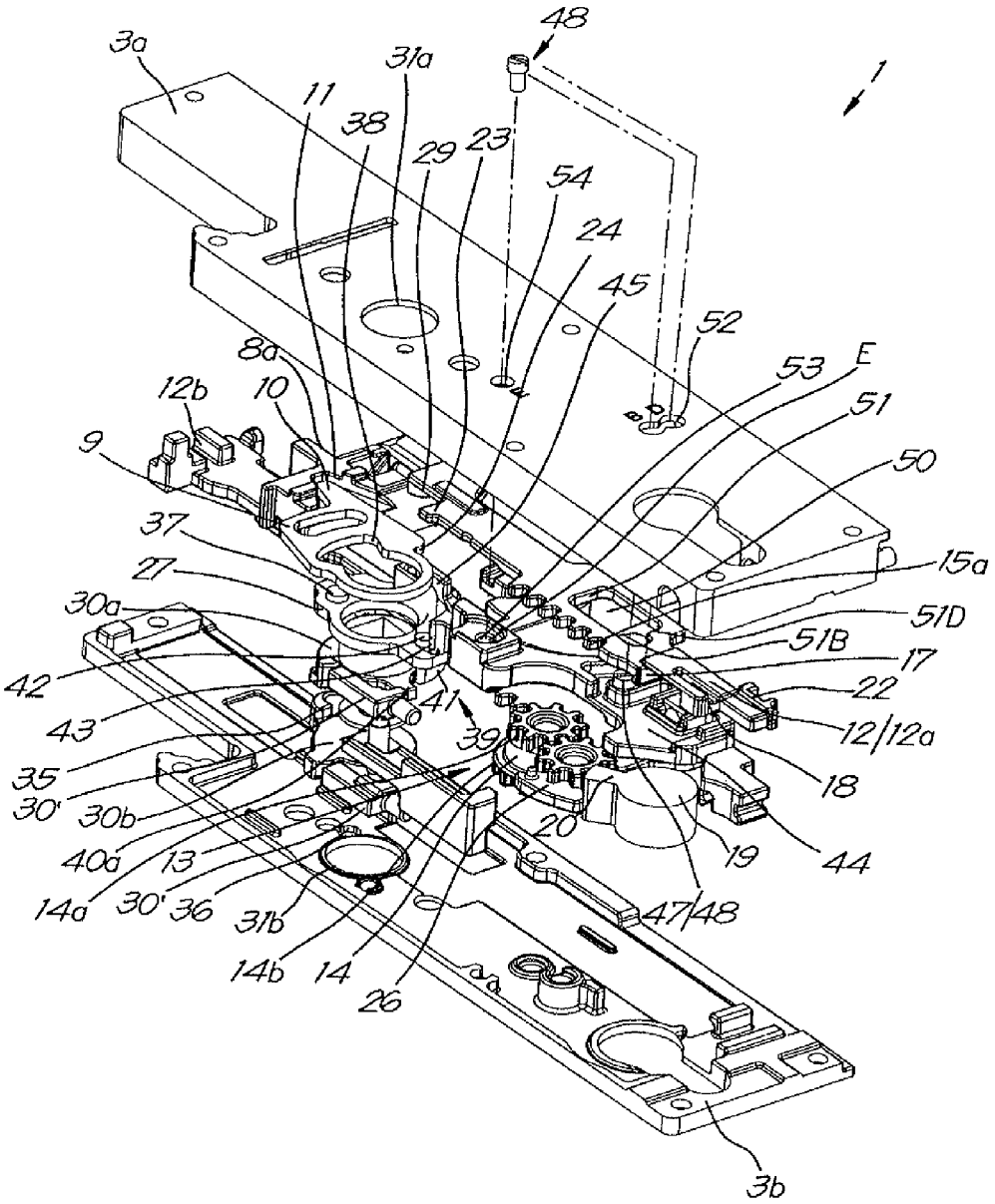
FIG. 2 shows the panic lock of FIG. 1 seen from the other side.

The panic lock 1 is further provided with a dead bolt 6 that can be moved in the lock case 3 between a locked position, whereby the dead bolt 6 partially protrudes out of the aforementioned side 3*c* of the lock case 3, as shown in FIGS. 3 and 4, and a retracted unlocked position in the lock case 3, as shown in FIGS. 1 and 2.

In the example shown, the dead bolt 6 is of the turnable type and provided with an arm 7 in the lock case 3 in order to be able to turn the dead bolt 6. The invention is however not limited to a lock with a turnable type of dead bolt but is equally applicable to a lock with a slidable dead bolt that can be moved between a locked position and an unlocked position.

A latch bolt 8 is also provided in the lock case 3 that is affixed so that it can move between a rest position whereby the latch bolt 8 protrudes partially out of the lock case 3 by means of a spring (not shown), as shown in FIGS. 1 to 4, and a retracted position in the lock case 3.

The latch bolt 8 consists of a holder 8*a* and a bolt 8*b* that is provided with a bevel 8*c* and which can be turned in the holder through 180°.

To retract the latch bolt 8 against the force of the spring, the panic lock 1 is equipped with a finger plate 9 for the latch bolt that is affixed so that it can turn in the lock case 3 and which is provided with a finger 10 that grips in a recess 11 in the latch bolt 8 and which, by turning, pulls the latch bolt 8 inwards.

To unlock and lock the dead bolt 6 and the latch bolt 8 an operating bar 12 is also provided that is affixed so that it can move in the lock case 3 in a direction parallel to the aforementioned side 3*c* of the lock case 3.

Although it is not excluded that the operating bar 12 is constructed from a single part, it is preferable that this operating bar 12 is constructed in two parts, i.e. a primary part 12*a* and a secondary part 12*b* that can move parallel to one another in the lock case 3, and whereby between the two parts 12*a* and 12*b* there is a transmission 13 that is such that a movement of the primary part 12*a* in a certain direction brings about a movement of the secondary part 12*b* in the same direction, and this with an increase of the movement, whereby the movement of the primary part 12*a* brings about a greater movement of the secondary part 12*b*.

The aforementioned transmission 13 is realised by means of a freely turning double gearwheel 14 with two coaxial sets of teeth 14*a* and 14*b*, one of which 14*a* meshes with a toothed rack 15*a* of the secondary part 12*a*, while the other set of teeth 14*b* meshes with the toothed rack 15*b* of the secondary part 12*b*, whereby the set of teeth 14*a* that meshes with the primary part 12*a* has a smaller number of teeth than the set of teeth 14*b* that meshes with the secondary part 12*b*.

The secondary part 12*b* is provided with a gudgeon 16 that can mesh with the aforementioned arm 7 of the dead bolt 6 in order to move it from the locked to the unlocked position or vice versa, depending on which direction the primary part 12*a* and thus the secondary part 12*b* is moved.

The primary part 12*a* is provided with two cams 17 and 18 that define a recess and which enable the primary part 12*a* to move in the one or the other direction by means of a cylinder lock 19 that is provided with a lip 20 that can be turned by means of a suitable key or similar, both from the inside 4 of the door 2 and the outside 5 of the door 2.

Figure 7:
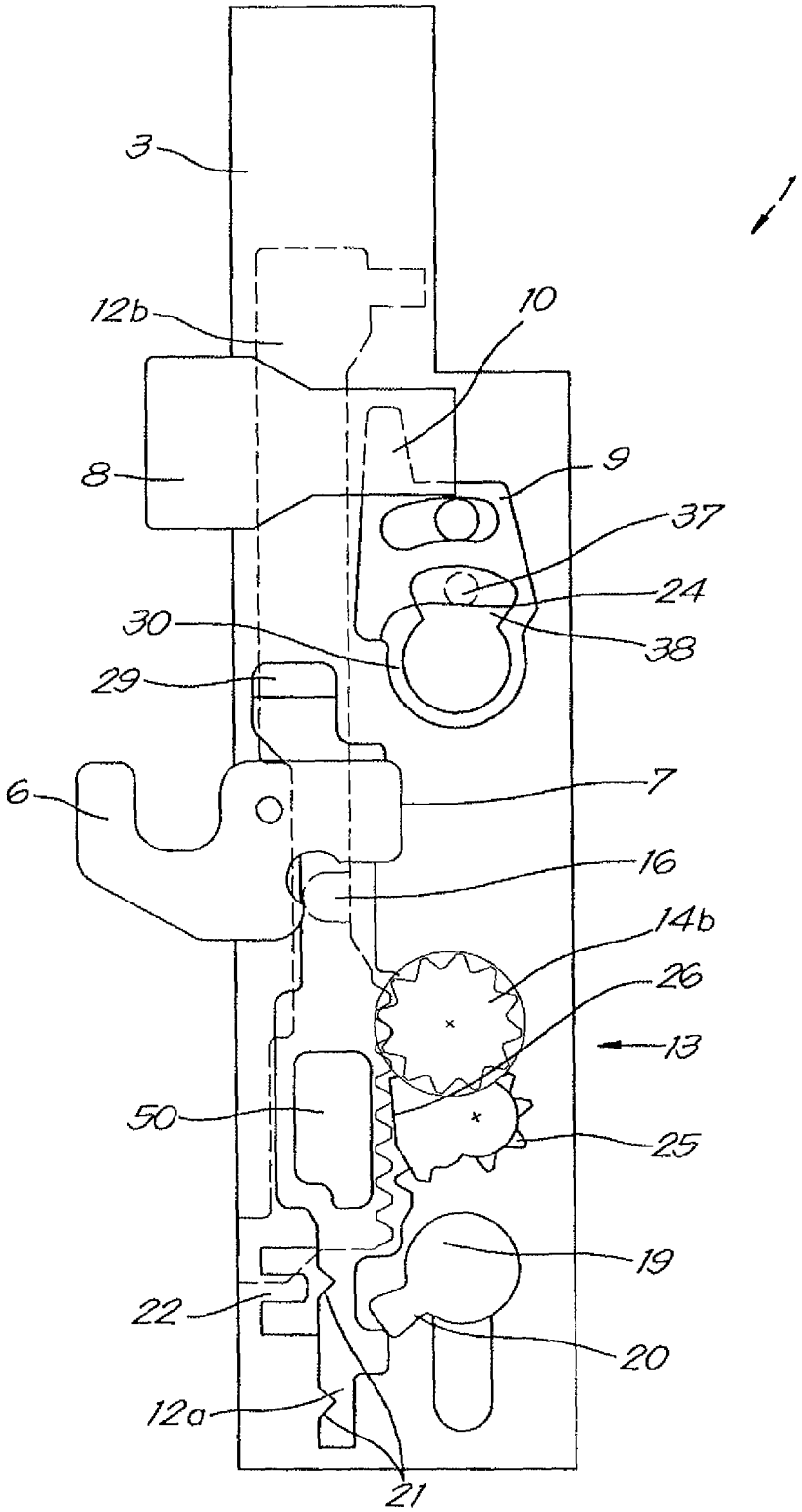
FIG. 7 shows a cross-section according to line VII-VII in FIG. 1.
Figure 8:
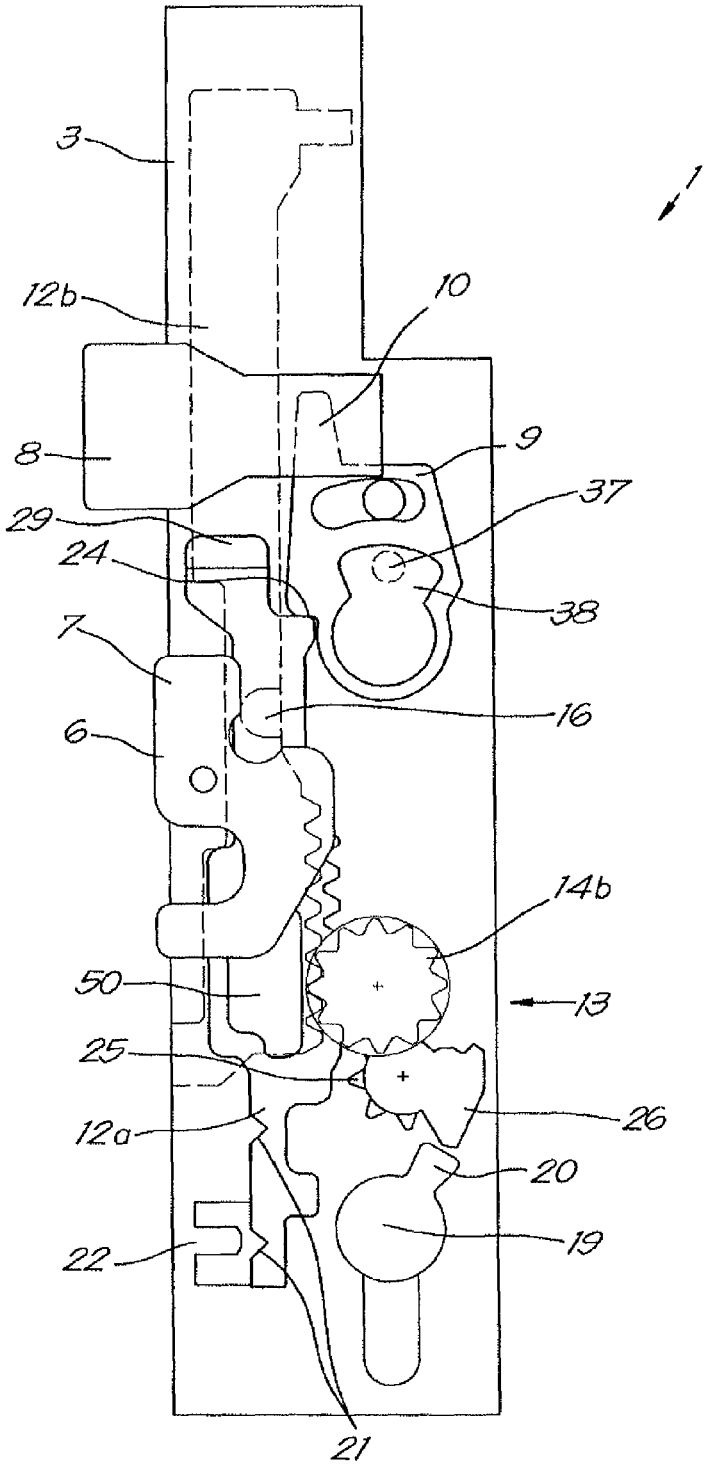
FIGS. 8 to 16 show cross-sections such as that of FIG. 7, but with more or less components that are omitted and this for different positions and functions of the panic lock.

The primary part 12*a* of the operating bar 12 can thereby be moved between three positions by means of the cylinder lock 19, respectively,

- a first end click position that is the furthest away from the latch bolt 8 and which is shown in FIG. 7, corresponding to a situation in which the dead bolt 6 is turned to the locked position, and thus partially protrudes from the lock case 3;
- an intermediate second click position whereby the primary part 12*a* is moved in the direction of the latch bolt 8 over a sufficient distance to retract the dead bolt 6 by means of the movement of the gudgeon 16 against the arm 7 of the dead bolt 6 in the lock case 3, as shown in FIG. 8, corresponding to a position whereby the door 2 is open;
- a third end position that is obtained by further turning the lip 20 of the cylinder lock 19 in order to further push the primary part 12*a* of the operating bar 12 from the second position in the direction of the latch bolt 8.

The two click positions are realised by two notches 21 in an edge of the operating bar 12*a* and by a click element 22 that can move in the lock case 3, and which is pushed in the direction of this edge by means of a spring (not shown), in order to click into a notch 21 concerned as it passes it by.

The primary part 12*a* of the operating bar 12 is provided with an end stop 23 that can engage with an end stop 24 of the finger plate 9 in order to turn it by a movement of the primary part 12*a* from the second to the third position by means of the cylinder lock 19, in order to retract the latch bolt 8 into the lock case 3.

In order to be able to move the operating bar 12*a* a sufficient distance by turning the cylinder lock 19, the aforementioned transmission 13 is provided with an additional gearwheel 25 that meshes with the double gearwheel 14 and which is provided with a radially oriented cam 26 that can engage with the lip 20 of the cylinder lock 19.

Figure 10:
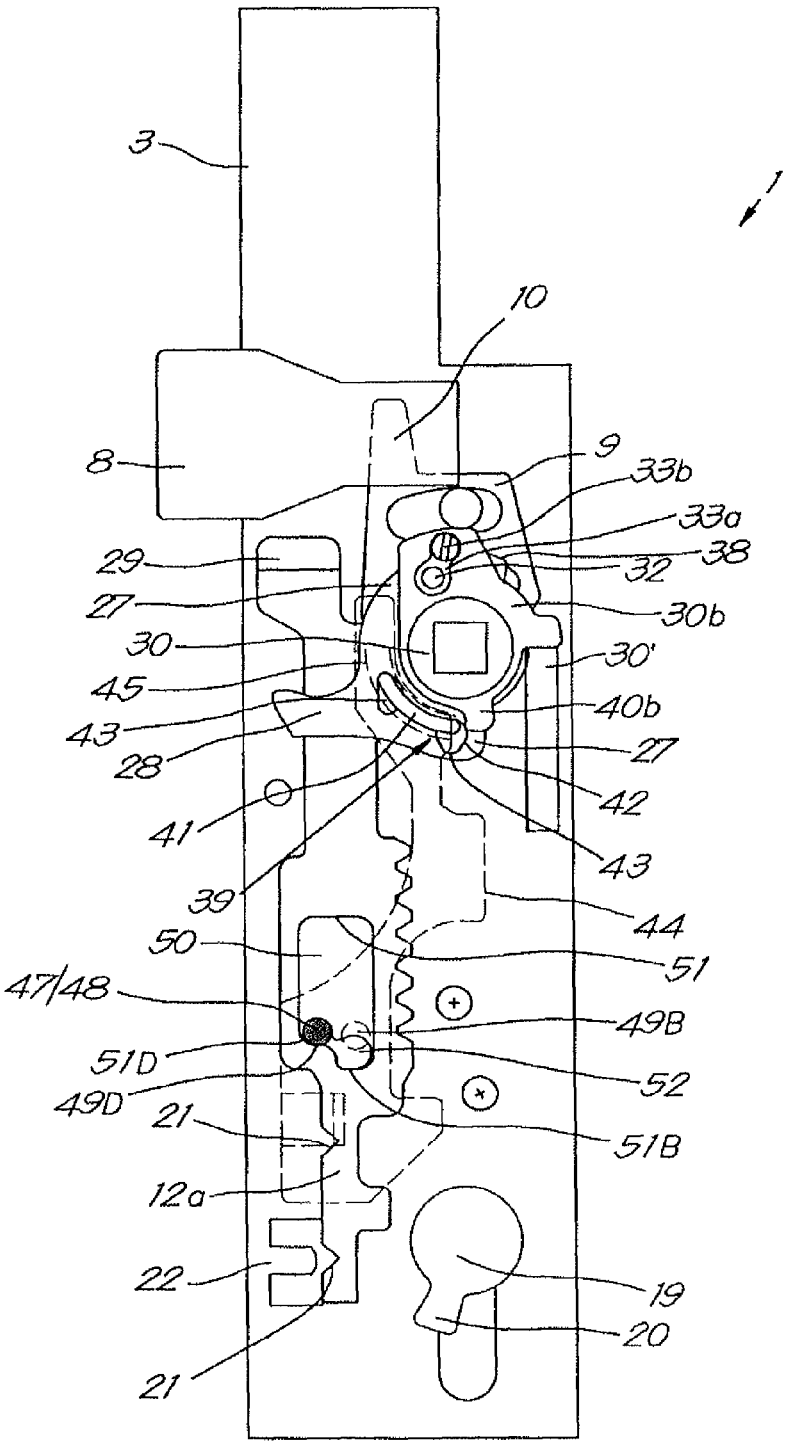
Figure 15:
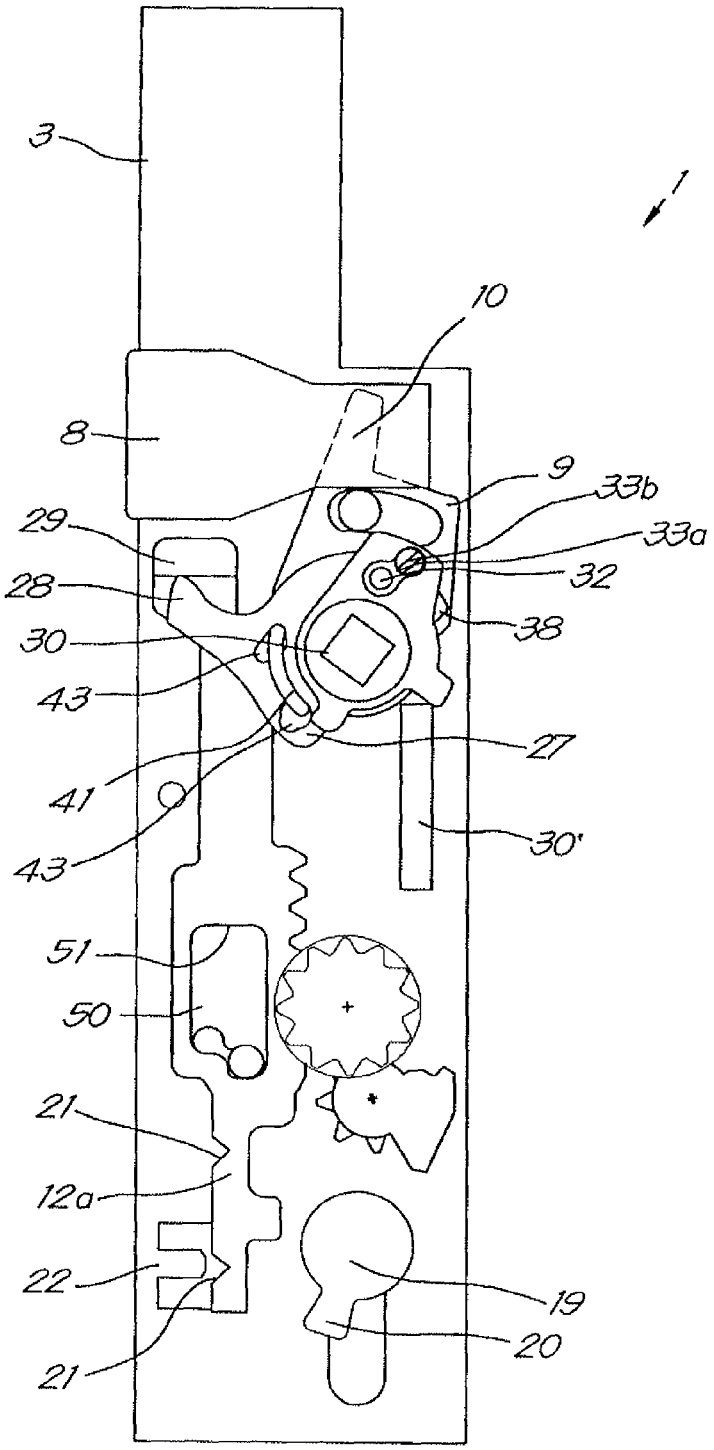

The operation of the operating bar 12*a* to unlock the dead bolt 6 is also made possible by a panic plate 27, and this panic plate 27 is shown in FIG. 10 in a rest position and which is affixed in the lock case 3 so that it can turn coaxially with the finger plate 9 and which is provided with a finger 28 that can engage with a rib 29 on the primary part 12*a* of the operating bar 12 upon turning, in order to move it from the first to the second position as shown in FIG. 15.

Both the finger plate 9 and the panic plate 27 can be operated by means of a handle K or similar on the inside 4 of the door 2 and possibly also on the outside 5 of the door 2, if desired.

To this end the panic lock 1 comprises two so called 'handle followers' 30, respectively 30*a* and 30*b*, that are mounted with bearings so that they can rotate coaxially around the shaft of the finger plate 9 and panic plate 27 between the cover 3*b* and the base 3*a* of the lock case 3, and which can each turn separately via an opening 31*b* in the cover 3*b* and via an opening 31*a* in the base 3*a* by means of an aforementioned handle K.

The handle followers 30 are each held in a rest position by means of a spring 30'.

Depending on the situation in which the panic lock 1 is mounted with the cover 3*b* on the outside or with the cover 3*b* on the inside, the handle follower 30 that is oriented inwards at that time will form the inside handle follower 30 that is intended to be turned by means of the handle on the inside of the door 2.

A handle follower 30 can thus, depending on the situation, act as an inside handle follower or as an outside handle follower.

The panic lock 1 is provided with means, in this case a screw 32 that enables the panic plate 27 to be connected in a tightened manner to the one handle follower 30*a* or the other handle follower 30*b* when fitting the panic lock 1, more specifically to the handle follower 30 that is intended to be used as an inside handle follower, while the handle follower 30 that is intended as an outside handle follower is not connected to it, so that this outside handle follower 30 can freely turn with respect to the panic plate 27 concerned.

The panic plate 27 concerned is provided with two threaded holes 33*a* and 33*b* located at positions at a radial distance from one another in which the screw 32 can be screwed according to choice, respectively a threaded hole 33*a* located most radially inwards whereby the screw 32 is held in a recess 34 of the handle follower 30*a* and a threaded hole 33*b* whereby the screw 32 can engage with a recess 35 of the other handle follower 30*b*.

The aforementioned threaded holes 33*a* and 33*b* in the panic plate 27 are preferably accessible upon assembly via an opening 36 in the lock case 3 in order to be able to move the screw 32 from the one position to the other depending on which handle follower 30 will be used as an inside handle follower.

The panic plate 27 is provided with a gudgeon 37 that falls in a recess 38 of the finger plate 9, as shown in dotted lines in FIGS. 7 and 8 for the rest positions of the handle followers 30*a* and 30*b*.

Figure 9:
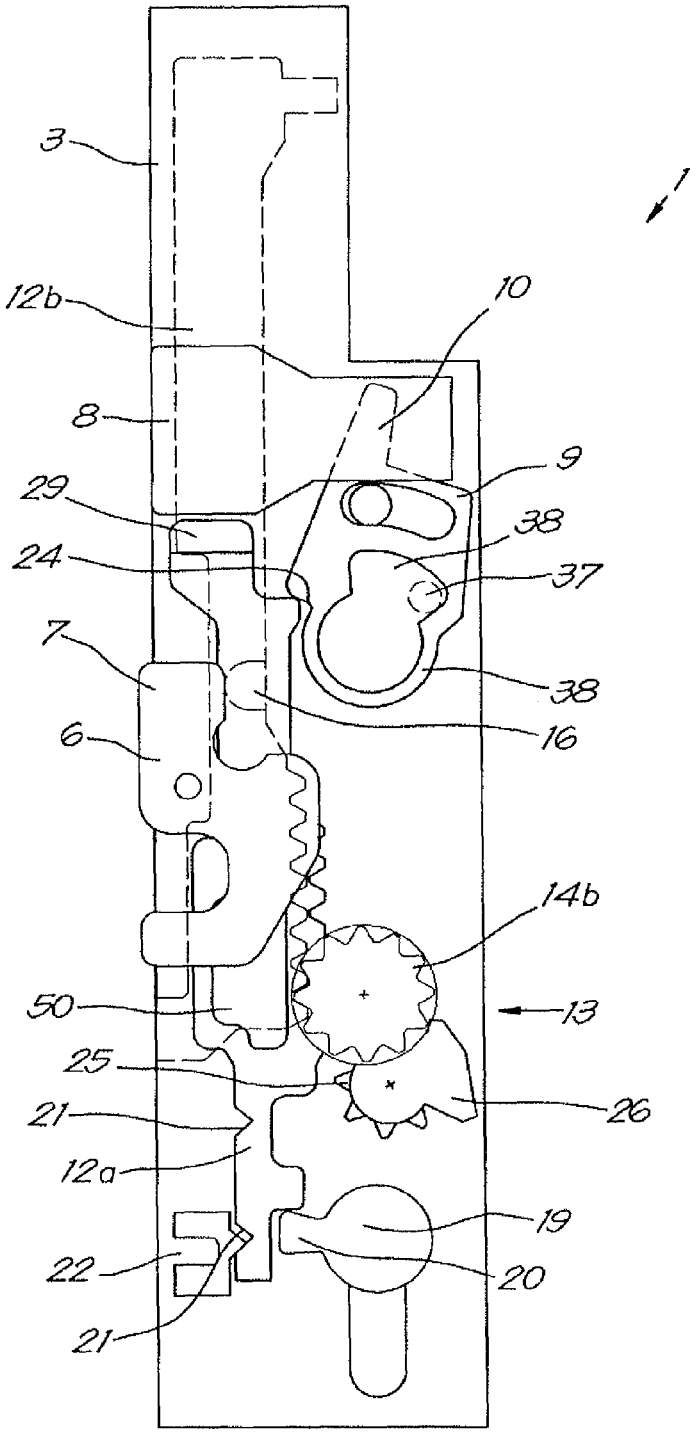

This recess 38 is such that, when the panic plate 27 is turned by turning the inside handle follower 30*a* or 30*b* from the rest position, the finger plate 9 is first not carried along because the gudgeon 37 can freely move in the recess 38, and is only taken as of a sufficient angular displacement, of 20° for example, in a turning movement, as shown in dotted lines in FIG. 9.

The panic lock 1 is further provided with an operatable coupling 39 for the mutual coupling or uncoupling of the turning movement of both handle followers 30*a* and 30*b*.

Figure 11:
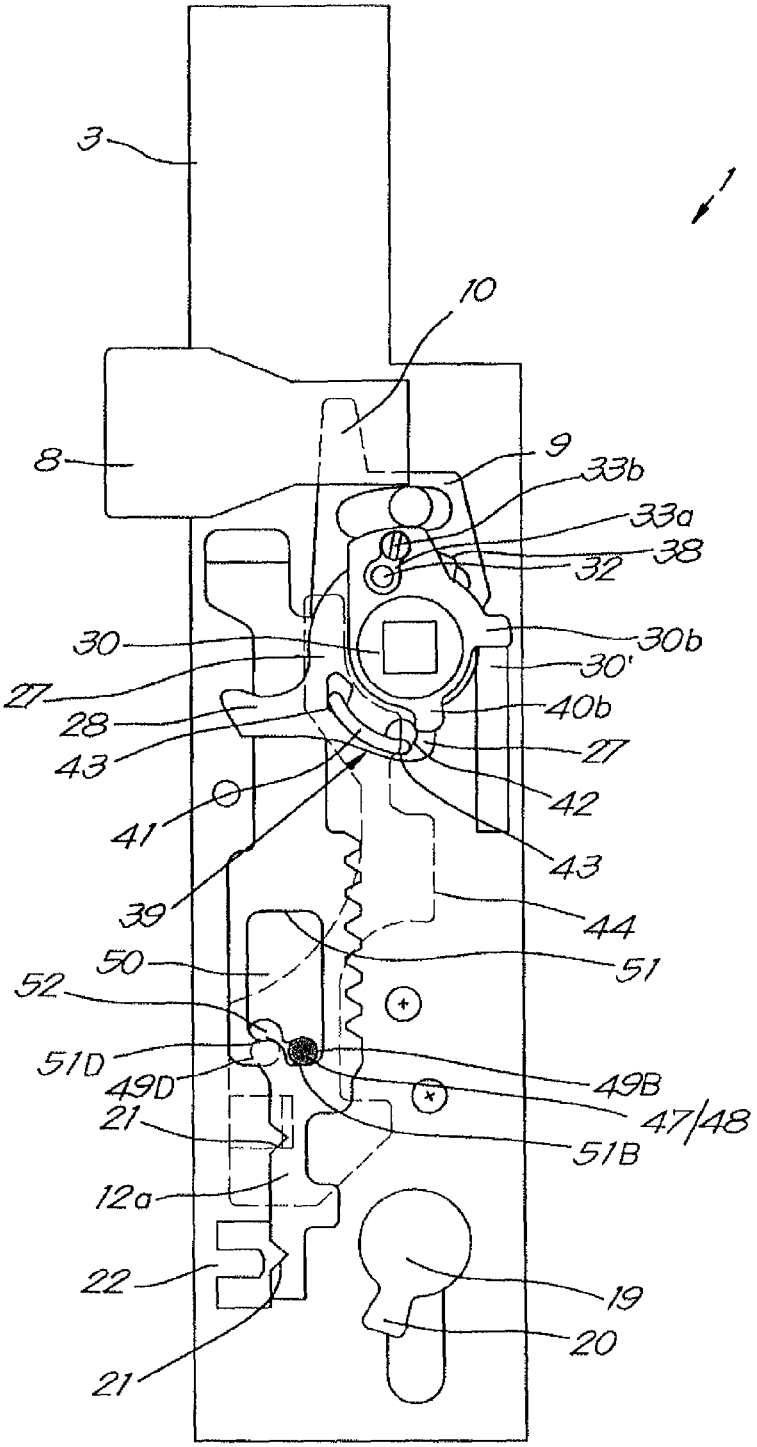

As shown in FIG. 10, the coupling 39 is formed by a radially oriented cam, respectively 40*a* and 40*b*, on each of the handle followers 30*a* and 30*b* and by a drive element 41 that is banana shaped in the example shown, and which is held movably with two feet 42 in slip holes 43 in the panic plate 27, and these slip holes 43 are more or less oriented radially with respect to the axis of rotation of the panic plate 27, all such that the drive element 41 is always carried along with this panic plate 27 in a turning movement, and at the same time can move in a radial direction between a coupled position, as shown in FIG. 10, whereby this drive element 41 is within the turning circle of the aforementioned cams 40*a* and 40*b* of the handle followers 30*a* and 30*b*, and a uncoupled position, as shown in FIG. 11, whereby the drive element 41 is outside this turning circle.

As a result in the coupled situation the panic plate 27 is carried along via the drive element 41 by the cams 40*a* and 40*b* of both handle followers 30*a* and 30 when they are turned from their rest position, while in the uncoupled situation the drive element 41 is outside the range of the cams 40*a* and 40*b* and the panic plate 27 is thus only carried along by the inside handle follower, which as already explained, is coupled to the panic plate 27 by means of the screw 32.

This aforementioned coupling 39 between the handle followers 30*a* and 30*b* can be operated by means of a coupling rod 44, which is affixed in the lock case 3 so that it can move and which is provided with a circular slot 45 that forms a guide for the drive element 41 and which enables a rotation of the drive element 41 around the axis of rotation of the handle followers 30.

A sliding movement of the coupling rod 44 is then also converted into a radial displacement of the drive element 41 in the slip holes 43 of the panic plate 27.

The coupling rod 44 can be moved between two click positions, respectively a click position as shown in FIG. 10, corresponding to a coupled situation of the handle followers 30*a* and 30*b*, and a click position as shown in FIG. 11 corresponding to a uncoupled situation of the handle followers 30*a* and 30*b*, whereby the click positions are determined by means of a click element 46.

The coupling rod 44 is provided with a catch 47 that is carried along by the primary part 12*a* of the operating bar 12 for coupling the handle followers 30 when it is moved in the direction of the latch bolt 8.

This catch 47 is formed, if applicable, by a screw 48 which, depending on the desired function B or D of the panic lock 1, can be screwed into one of the two threaded holes 49B or 49D that are provided in the coupling rod 44, whereby the head of the screw 48 is held so that it can move in a recess 50 of the operating bar 12 whose edge, depending on the position of the screw 48, forms an end stop 51B or 51D for the head of the screw 48 when the operating bar 12 is moved in the direction of the latch bolt 8.

The threaded holes 49B and 49D are accessible from the outside of the panic lock 1 via an opening or openings 52 in the lock case 3 for moving and/or screwing an aforementioned screw 48 in and/or out.

The position of the screw 48 in the one threaded hole 49B or the other threaded hole 49D determines the panic function B or D of the panic lock 1, and these functions are indicated in the corresponding openings in the lock case 3 for the user by the letters B and D.

FIG. 11 shows the situation whereby the screw 48 is affixed in the threaded hole 49B corresponding to panic function B.

In this situation the position of the screw 48 is chosen with respect to the end stop edge 51B of the recess 50 such that, upon a movement of the primary part 12*a* of the operating bar 12 from the first to the third position, the coupling rod 44 is not carried along in the first part of the movement from the first to the second position, and thus the coupling rod 44 is only carried along during the last part of the movement from the second to the third position.

This means that when panic function B is chosen, the turning of the inside handle follower 30 for retracting the dead bolt 6 does not result in a coupling of the handle followers 30*a* and 30*b* as the third position of the operating bar 12 is not reached, such that the outside handle follower 30 remains uncoupled and no access is possible from the outside.

In this situation it is necessary to push the operating bar 12 to the third position with the lip 20 of the cylinder lock 19 in order to couple the outside handle follower 30 and thus to enable access with the outside handle.

FIG. 10 shows the situation whereby the screw 48 is affixed in the threaded hole 49D corresponding to the panic function D.

In this situation the position of the screw 48 with respect to the end stop edge 51D of the recess 50 corresponding to panic function D is chosen such that, when the primary part 12*a* of the operating bar 12 is moved from the first to the second position, the coupling rod 44 is carried along. With this function D the operating bar 12 cannot be moved to the third position and in other words the latch bolt 8 cannot be pulled backwards by means of the key.

This means that, when panic function D is chosen, the turning of the inside handle follower 30 to retract the dead bolt is already sufficient to realise a coupling between the handle followers 30*a* and 30*b* and thus to enable access from the outside by operating the outside handle.

It is clear that the same result can be obtained by providing a permanent catch 47 at the position of the threaded hole 49B corresponding to position B, and by providing a permanent catch 47 at the position of the threaded hole 49D corresponding to position D, in the form of a screw 48 that is carried along if panic function B is chosen, and which is screwed into the threaded hole 49D when panic function D is chosen.

In the example, threaded holes 49B and 49D in the coupling rod 44 are at the same level viewed in the direction of movement of the operating bar 12, while the end stops 51B and 51D formed by the edge of the recess 50 in the operating bar 12 extend on two different levels for the functions B and D.

However, it is not excluded that these end stops 51B and 51D are on the same level and that the threaded holes 49B and 49D are on a different level.

What is important is that, viewed in the direction of movement of the operating bar 12, the distance from the catch 47 in the panic function B situation to the end stop 51B corresponding to this situation, is greater than the distance from the catch 47 in the panic function D situation to the end stop 51D corresponding to this situation.

It could also be possible to realise a catch 47 in a different way than with a screw, for example as a slidable or tiltable element that can be taken from the one position or situation to the other.

Optionally the panic lock 1 can be provided with an interlock that enables the coupling rod 44 to be locked with respect to the lock case 3 in the coupled position of the coupling rod 44, or to be unlocked depending on the desired function of the panic lock 1, for example when a permanent coupling is desired between the handle followers 30*a* and 30*b*, and thus must also be permanently possible to come from the outside to the inside by means of a handle, or when for example no handle must be provided on the outside of the door 2, which corresponds to a 'function E'.

This function E is formed for example by the screw 48 that can be screwed into a threaded hole 53 in the coupling rod 44 in order to lock it in the lock case 3, whereby the head of the screw 48 is then countersunk for example in a passage 54 in the lock case 3 in order to prevent a movement of the coupling rod 44, and which is indicated by E for example.

In this way it is possible, according to desire, to give the panic lock 1 a different function B, D or E by moving a single screw 48.

The operation of the panic lock 1 is explained on the basis of FIGS. 12 to 16 in which the panic lock is mounted such that the handle follower 30*b* is the inside handle follower that is connected to the panic plate 27 by means of the screw 32.

The basis is that the panic lock 1 is fitted vertically in a door 2 with the latch bolt 8 on top and the dead bolt 6 underneath.

Unlocking of the Dead Bolt 6 by Means of the Cylinder Lock 19.

Figure 12:
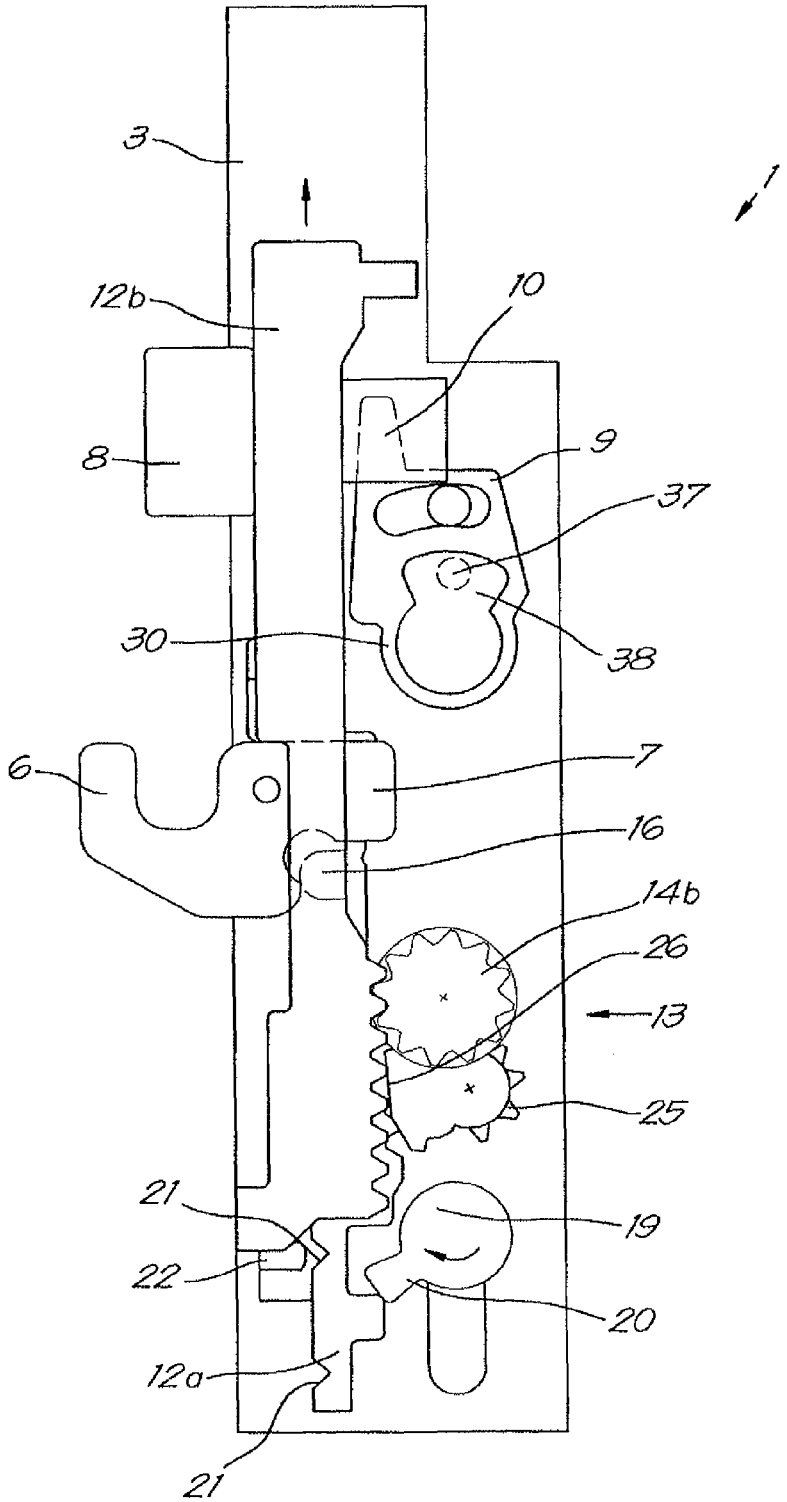

Starting from FIG. 12, in which the dead bolt 6 is turned to the locked position and the primary part 12*a* of the operating bar 12 is in the first bottom click position, the dead bolt 6 is turned to an unlocked position by turning the cylinder lock 19 clockwise such that the lip 20 pushes the primary part 12*a* of the operating bar 12 upwards and the transmission 13 also pushes the secondary part 12*b* upwards with an increase of movement with respect to the primary part 12*a*.

Figure 13:
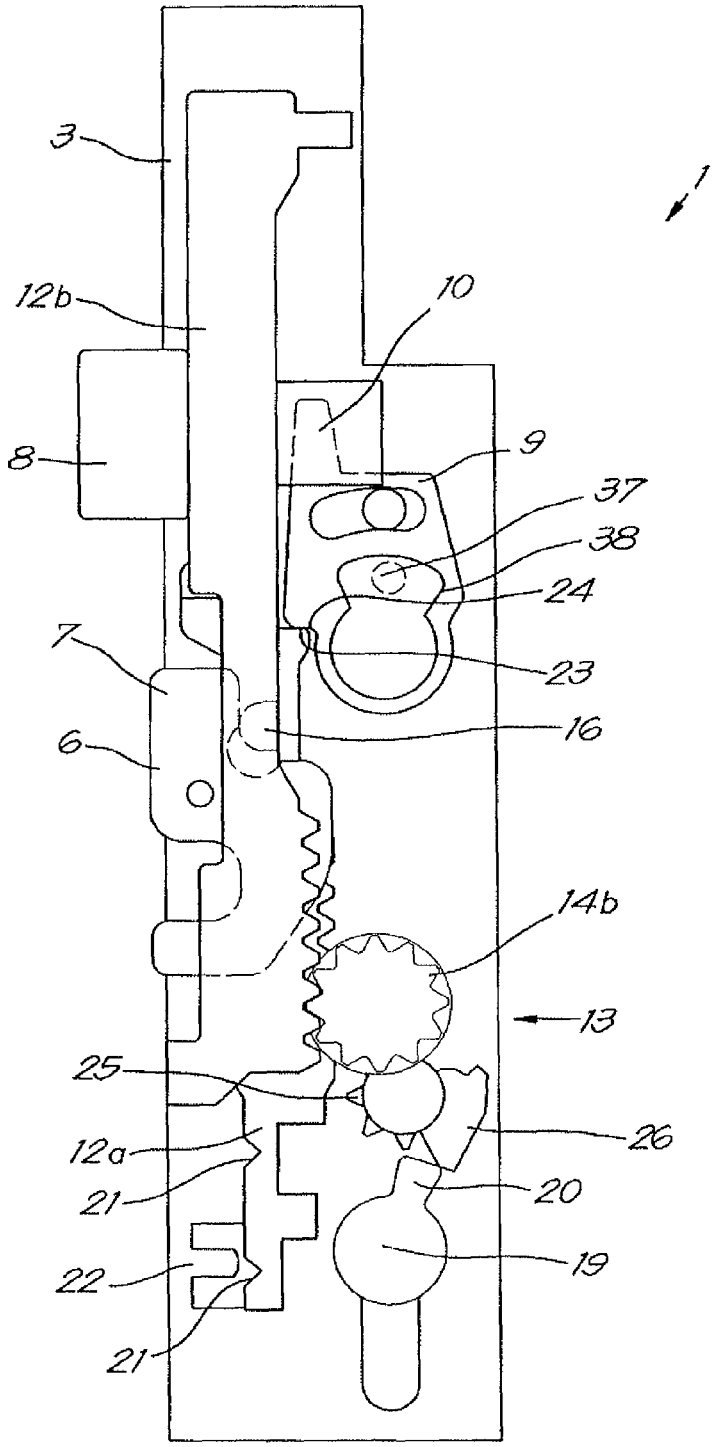

Approximately in the middle of the travel of the operating bar 12, the lip 20 of the cylinder lock 19 carries along the additional drive gearwheel 25 in the anticlockwise direction and this drive gearwheel 25 in turn carries along the double gearwheel 14 along with it, such that the secondary part 12*b* of the operating bar 12 moves further in the upward direction up to the second click position and the gudgeon 16 thereby pushes against the arm 7 of the dead bolt 6 it order to turn it inwards through 90° to a position as shown in FIG. 13.

Closing of the Dead Bolt 6 by Means of the Cylinder Lock 19.

Starting from FIG. 13, the panic lock can be dead locked by means of the cylinder lock 19.

When turning the key in the anticlockwise direction the lip 20 of the cylinder lock 19 carries along the primary part 12*a* of the operating bar 12 in a downward direction up to the first click position, such that the transmission 13 with the double gearwheel 14 also moves the secondary part 12*b* with the gudgeon 16 downwards, such that the gudgeon 16 makes the dead bolt 6 turn outwards to again arrive at a situation as shown in FIG. 12.

During this movement the catch 47 formed by the screw in the position 49B and 49D, together with the coupling rod 44, is carried along by the top edge 51 of the recess 50 in the operating bar 12*a*. When the dead bolt 6 is turned to the locked position, the handle followers 30*a* and 30*b* are consequently always uncoupled.

Pulling Back of the Latch Bolt 8 by Means of the Cylinder Lock 19.

Figure 14:
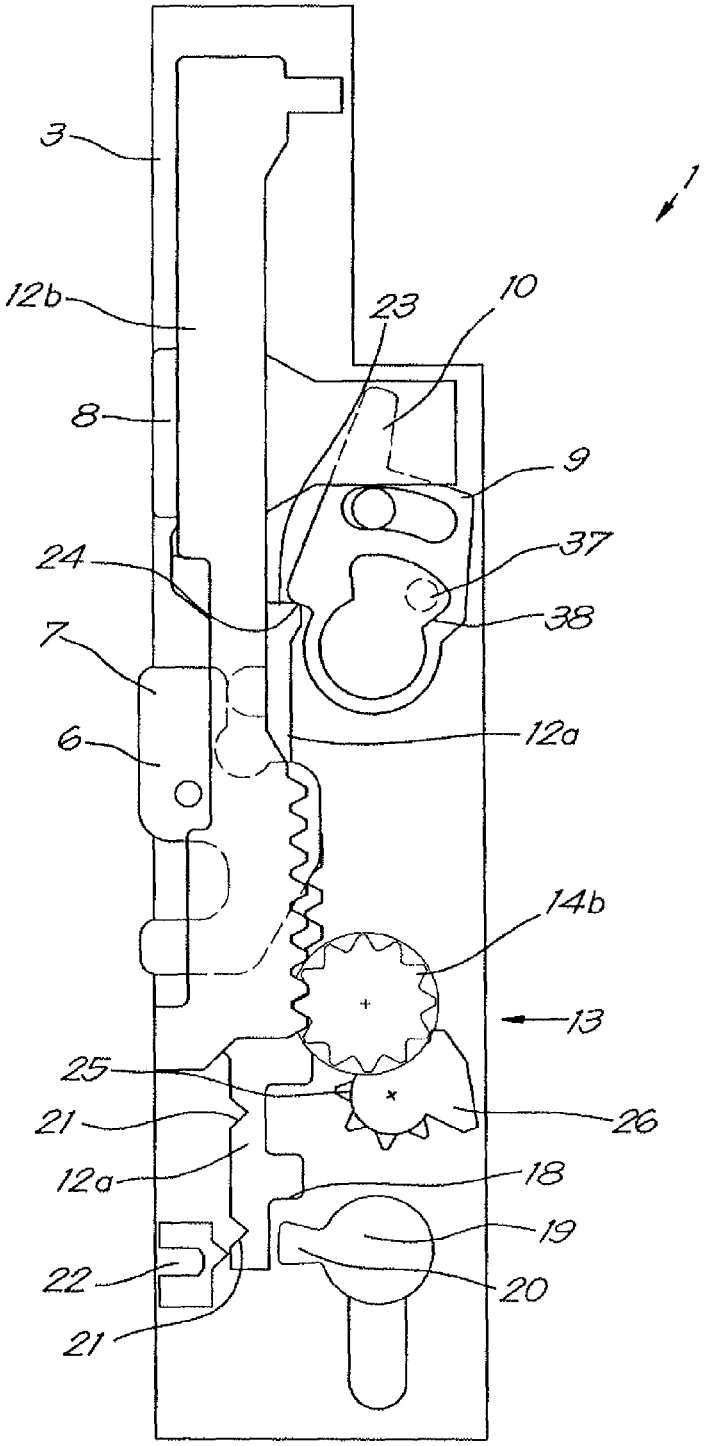

In the situation of FIG. 13 the latch bolt 8 can be pulled backwards by turning the lip 20 of the cylinder lock 19 further in the clockwise direction whereby the lip 20 pushes against the underside of the cam 18 of the operating bar 12, as shown in FIG. 14, and pushes this further upwards from the second position over a number of millimeters to the third position, such that the end stop 23 of the operating bar 12 pushes against the end stop 24 of the finger plate 9, and tilts it in the clockwise direction in order to thereby pull back the latch bolt 8 as shown in FIG. 14.

Retraction of the Dead Bolt 6 and Latch Bolt 8 by Means of the Inside Handle (Panic Function).

When, on the basis of the situation of FIG. 12, the handle on the inside of the door 2 (=panic side) is pushed downwards, the inside handle follower 30*b* turns in the clockwise direction through an angle of approximately 40°.

The inside handle follower 30*b* that is connected by means of the screw 32 to the panic plate 27 carries this panic plate 27 with it, which in turn pushes the operating bar 12 upwards from the first position in the direction of the second position, as shown in FIG. 15, whereby the dead bolt 6 is turned inwards, without the latch bolt 8 initially being retracted as the operating bar 12 cannot move further than the second click position by means of the inside handle follower 30*b*.

The gudgeon 37 of the panic plate 27 that is in the recess 38 of the finger plate 9, after turning by around twenty degrees, is carried along by the panic plate 27, such that the latch bolt 8 is also retracted as shown in FIG. 15, and this before the second click position is reached.

It is thus always possible, in the event of panic, for example fire, to open the door 2 from the inside 5 of the door 2 and to flee to the outside.

Coupling of the Outside Handle Follower by Means of the Cylinder Lock 19.

Figure 16:
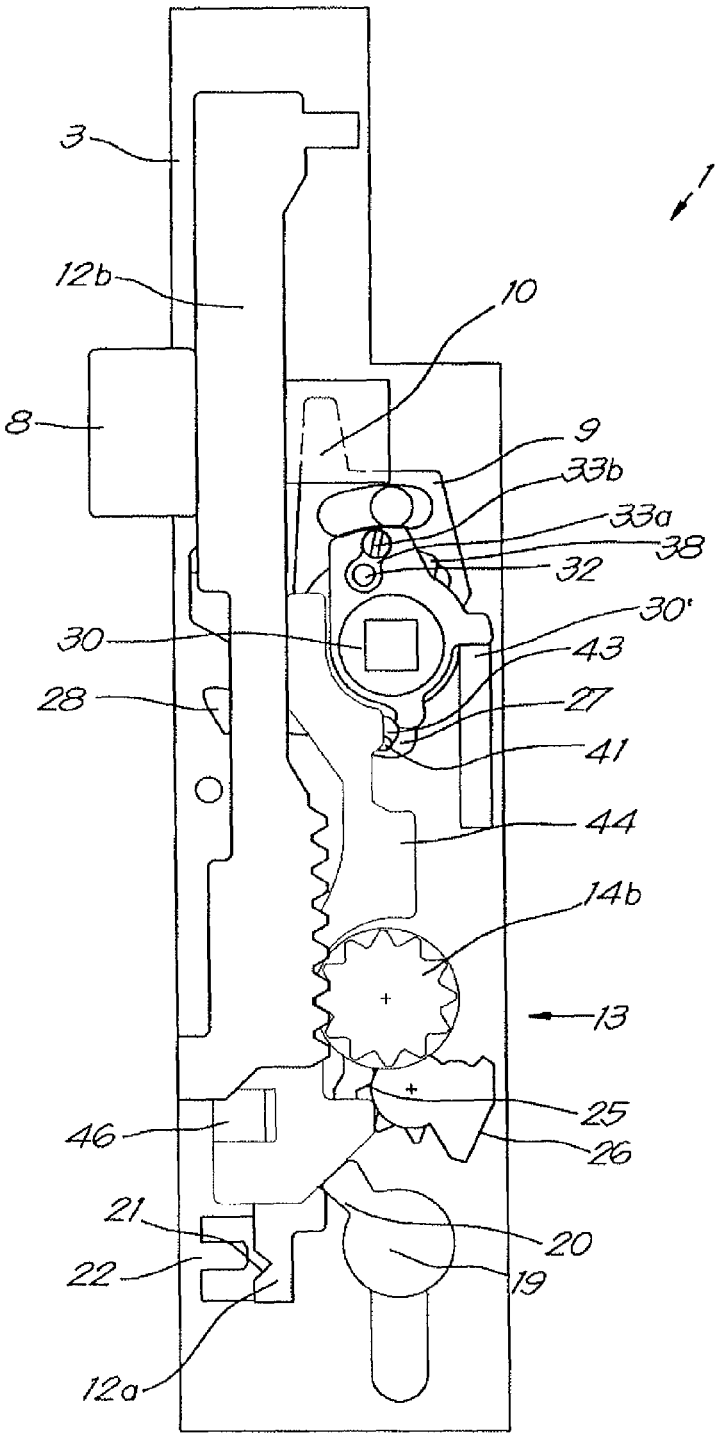

In order to be able to operate the panic lock 1 from the outside by means of the outside handle follower 30*a*, for example to admit the emergency services, a coupling between the handle followers 30*a* and 30*b* can be brought about by moving the coupling rod 44 upwards by operating the cylinder lock 19 in the clockwise direction, as shown in FIG. 16, which comes down to unlocking by means of the key.

It is then possible to unlock the panic lock 1 from both the inside and outside by means of a handle.

This is possible with the screw 48 set for function B and for function D.

Coupling of the Outside Handle Follower Only by Means of the Inside Handle Follower (Function D)

When the screw 48 that acts as a catch 47 for the coupling rod 44 is placed in the function D position, then a turn of the inside handle follower 30*b* will move the operating bar 12 upwards to the second click position, and the screw 48 in this position D and thus also the coupling rod 44 will be carried along by the operating bar 12, as already shown in FIG. 10.

As a result, the coupling rod 44 is moved from the bottom uncoupled click position to its top coupled click position and the handle followers 30*a* and 30*b* are thus coupled, such that it is possible, after operating the inside handle follower 30*b*, to open the door 2 with the outside handle follower 30*a*, if this is desired.

Coupling of the Outside Handle Follower by Means of the Inside Handle Follower in Combination with the Cylinder Lock 19 (Function B)

When the screw 48 that acts as a catch 47 for the coupling rod 44 is placed in the function B position, then a turn of the inside handle follower 30*b* will move the operating bar upwards to the second click position, but in this movement the screw 48 in the position B will not be carried along by the operating bar 12, as shown in FIG. 11.

The handle followers 30*a* and 30*b* thus remain uncoupled.

In order to still realise a coupling between the handle followers 30*a* and 30*b* it is also necessary to retract the latch bolt 8 by means of the cylinder lock 19, as explained above on the basis of FIGS. 13 and 14, in order to push the operating bar 12 further upwards to the third position, to pull the screw in the position B upwards and to move the coupling rod 44 to its top coupled position.

Coupling of the Outside Handle Follower by Locking the Coupling Rod 44 in the Coupled Position (Function E).

In order to permanently couple the handle followers 30*a* and 30*b* together, the coupling rod 44 can be locked in its coupled top position by moving the screw 48 to position E. This can apply for example when a fixed catch is provided on the outside of the door 2, i.e. one that cannot be turned.

It is clear that in a simple way, by moving a screw 48, the panic lock 1 can be converted according to desire to fulfil different functions and to be able to use the panic lock 1 as both a left lock and in the form of a right lock.

Although in the example shown the lock is described without handles, the invention is equally applicable to a lock with one or two handles which, either engage in the handle followers, either also fulfil the function of the handle followers.

The present invention is by no means limited to the embodiment described as an example and shown in the drawings, but a panic lock 1 according to the invention can be realised in all kinds of variants and in different ways, without departing from the scope of the invention.

The invention claimed is:

1. A panic lock for fitting in a door, said panic lock comprising:

a lock case;

a dead bolt;

a latch bolt;

an operating bar that can move in the lock case between three positions, respectively a first, second and third position, whereby the operating bar can cooperate with the dead bolt to retract the dead bolt in the lock case by a movement of the operating bar from the first to the second position, and which can cooperate with the latch bolt to retract the latch bolt in the lock case by a further movement of the operating bar from the second position to the third position;

a cylinder lock with a lip that can be rotated in the lock case to move the operating bar; two handle followers or handles that can turn coaxially with respect to one another in the lock case, respectively an inside handle follower or handle and an outside handle follower or handle that are pushed to a rest position by means of a spring;

a finger plate and a panic plate that are affixed so that they can turn in the lock case, respectively a panic plate in order to, upon turning, retract the dead bolt by operating the inside handle follower or handle, and a finger plate to retract the latch bolt upon turning;

whereby the inside handle follower or handle is coupled to the finger plate and the panic plate such that an angular displacement of the inside handle follower or handle from the rest position causes a movement of the panic plate that hereby moves the operating bar from the first to the second position, and that after a first phase of the angular displacement of the inside handle follower or handle the finger plate is carried along in the angular movement to retract the latch bolt, whereby the panic lock is provided with an operatable coupling for the mutual coupling or uncoupling of the turning movement of both handle followers or handles with respect to one another, wherein the coupling can be operated by a coupling rod that is slidably provided in the lock case so that it can move between two positions corresponding respectively to a coupled and uncoupled position of the handle followers or handles and whereby the coupling rod is provided with a catch that can cooperate with the operating bar for coupling the handle followers or handles when it is moved from the first to the third position, and wherein the catch can be put in two positions or states depending on the desired function of the panic lock, 'position B' that is such that upon a movement of the operating bar from the first to the third position, the coupling rod is only carried along during the movement from the second to the third position, and, a 'position D', whereby upon a movement of the operating bar the coupling rod is carried along from the first to the second position.

2. The panic lock according to claim 1, wherein for each position B and D of the catch the operating bar is provided with an end stop, whereby, the distance from the catch in the position B to the end stop corresponding to the position B of the catch is greater than the distance from the catch in the position D to the end stop corresponding to this position D of the catch.

3. The panic lock according to claim 1, wherein the coupling rod is provided with at least one threaded hole in a position corresponding to the aforementioned position D of the catch and wherein the catch is formed by a screw that can be screwed in the threaded hole, hereby the screw is held in a recess of the operating bar so that it can move and the screw's edge forms an aforementioned end stop for the catch.

4. The panic lock according to claim 3, wherein the coupling rod is provided with a second threaded hole in a position corresponding to the aforementioned position B of the catch, whereby the screw that acts as a catch can be moved from the first threaded hole to the second threaded hole.

5. The panic lock according to claim 3, wherein the first and/or the second threaded holes are accessible through an opening or openings in the lock case from the outside of the panic lock to move and/or screw in and/or out the aforementioned screw.

6. The panic lock according to claim 1, wherein the panic lock is provided with an interlock that enables the coupling rod to be locked or unlocked with respect to the lock case in the coupled position of the coupling rod.

7. The panic lock according to claim 3, wherein the panic lock is provided with an interlock that enables the coupling rod to be locked with respect to the lock case in the coupled position of the coupling rod, whereby the locking is formed by a screw that can be screwed into a threaded hole in the coupling rod in order to lock the coupling rod, whereby this screw is held in a passage in the lock case so that the screw cannot be moved in the coupling rod.

8. The panic lock according to claim 3, wherein the panic lock is provided with only a single screw, which can be used either as a catch in one of the threaded holes corresponding to the position B or D, or as a lock in the threaded hole at position E for blocking the coupling rod in the coupled position.

9. The panic lock according to claim 1, wherein the coupling rod and the cylinder lock are positioned such that the coupling rod can be moved in the coupled position by turning the lip of the cylinder lock in order to unlock.

10. The panic lock according to claim 1, wherein the coupling is formed by a drive element that is fastened to the panic plate whereby the drive element turns together with this panic plate and can be moved with respect to the panic plate, between a position in which this drive element is within a cam on each of the handle followers or handles and a position in which the drive element is outside the cam.

11. The panic lock according to claim 10, wherein the aforementioned drive element is held in a guide of the coupling rod so that the drive element can rotate, and enables a turn of the drive element around the handle followers or handles.

12. The panic lock according to claim 1, wherein the panic lock is provided with means that enable the panic plate to be tightly connected to the handle follower or handle, that is intended to be used as the inside handle follower or handle.

13. The panic lock according to claim 12, wherein the means that enable the panic plate to be tightly connected to the one or the other handle follower or handle, are formed by a screw that can be screwed in a threaded hole in the panic plate in two possible positions located at a radial distance, respectively one position whereby the screw can cooperate with a single handle follower or handle and another position whereby the screw can engage with the other handle follower or handle.

14. The panic lock according to claim 13, wherein the aforementioned threaded holes in the panic plate are accessible through an opening in the lock case to be able to move the screw from the first position to the second position, depending on which handle follower or handle will be used as the inside handle follower or handle.

15. The panic lock according to claim 1, wherein the operating bar is constructed in two parts, respectively a primary part and a secondary part, that can be moved parallel to one another in the lock case, whereby a transmission is provided between the two parts that is such that a movement of the primary part in a certain direction brings about a movement of the secondary part in the same direction.

16. The panic lock according to claim 15, wherein the primary part can be moved by means of the cylinder lock and/or by means of the panic plate and that the secondary part is provided with a gudgeon that can cooperate with the dead bolt in order to move the secondary part from the locked to the unlocked position or vice versa.

17. The panic lock according to claim 15, wherein the transmission is such that a movement of the primary part brings about a greater movement of the secondary part.

18. The panic lock according to claim 15, wherein the transmission has a freely turning double gearwheel with two sets of teeth, of which one set of teeth meshes with a toothed rack of the primary part, while the other set of teeth meshes with the toothed rack of the secondary part, whereby the sets of teeth of the double gearwheel have a different number of teeth.

19. The panic lock according to claim 15, wherein the panic lock is provided with an additional gearwheel that meshes with the double gearwheel and which is provided with a cam that can cooperate with the lip of the cylinder lock.

20. The panic lock according to claim 1, wherein the dead bolt is a dead bolt that can turn in the lock case.

* * * * *